US008933766B2

(12) United States Patent
Oo et al.

(10) Patent No.: US 8,933,766 B2
(45) Date of Patent: Jan. 13, 2015

(54) PHASE SHIFTER WITH OVERLAPPING FIRST AND SECOND U-SHAPED PATTERNS

(75) Inventors: Jung-Keun Oo, Gyeonggi-do (KR); Min-Seok Jung, Gyeonggi-do (JP); Battalov Ilnar, Incheon-si (KR)

(73) Assignee: Ace Technologies Corporation, Incheon-si (KR)

( * ) Notice: Subject to any disclaimer, the term of this patent is extended or adjusted under 35 U.S.C. 154(b) by 289 days.

(21) Appl. No.: 13/380,335

(22) PCT Filed: Jul. 2, 2009

(86) PCT No.: PCT/KR2009/003615
§ 371 (c)(1),
(2), (4) Date: Dec. 22, 2011

(87) PCT Pub. No.: WO2010/150934
PCT Pub. Date: Dec. 29, 2010

(65) Prior Publication Data

US 2012/0098619 A1 Apr. 26, 2012

(30) Foreign Application Priority Data

Jun. 25, 2009 (KR) ..... 10-2009-0057291

(51) Int. Cl.
*H01P 1/18* (2006.01)

(52) U.S. Cl.
CPC ..... *H01P 1/184* (2013.01)
USPC ..... 333/161; 333/139

(58) Field of Classification Search
CPC ..... H01P 1/18; H01P 1/184
USPC ..... 333/161, 156, 139; 342/372, 375
See application file for complete search history.

(56) References Cited

U.S. PATENT DOCUMENTS 3,849,745 A * 11/1974 Schellenberg et al. ..... 333/161
4,276,551 A * 6/1981 Williams et al. ..... 342/375
6,831,602 B2 * 12/2004 McKinzie et al. ..... 342/375
7,224,246 B2 5/2007 Thomas

* cited by examiner

*Primary Examiner* — Benny Lee
(74) *Attorney, Agent, or Firm* — AlbertDhand LLP

(57) ABSTRACT

A feeding system for providing a power using metal patterns having 'U' shape is disclosed. A phase shifter as the feeding system includes a first substrate, a first pattern as a conductor disposed on the first substrate, a second substrate separated from the first substrate and a second pattern as a conductor disposed on the second substrate. Here, the first pattern is overlapped with the second pattern, and electrical length of overlapped part of the patterns changes in case of changing phase of an RF signal outputted from the phase shifter.

15 Claims, 6 Drawing Sheets

(A)

(B)

(A)

(B)

PHASE SHIFTER WITH OVERLAPPING FIRST AND SECOND U-SHAPED PATTERNS

TECHNICAL FIELD

Example embodiment of the present invention relates to a feeding system, and a phase shifter and a delay device included in the same, more particularly relates to a feeding system for providing a power using metal patterns having 'U' shape, and a phase shifter and a delay device included in the same.

RELATED ART

A feeding system supplies a power inputted from an outer device to other device through its output terminal, and may be for example a phase shifter employed in an antenna shown in following FIGS. 1A & 1B.

FIGS. 1A & 1B are views illustrating a common antenna.

In FIGS. 1A & 1B, the antenna includes a reflector 100, phase shifters 102 (FIG. 1A) formed on one surface of the reflector 100 and radiators 104 (FIG. 1B) formed on another surface of the reflector 100.

The phase shifter 102 changes phase of a power (RF signal) delivered to corresponding radiators 104, thereby adjusting angle of a beam outputted from the radiators 104, i.e. tilting angle of the antenna.

Since three radiators 104 are usually connected to one phase shifter 102, five phase shifters 102 are required when the power is provided to the radiators 104, e.g. fifteen radiators, i.e. fifteen ports are realized. Accordingly, five phase shifters 102 are disposed in serial on one surface of the reflector 100, and thus the size of the antenna increases.

In addition, the phase shifters 102 are controlled individually, and thus it is difficult and inconvenient to control the tilting angle of the antenna to desired angle.

SUMMARY OF THE INVENTION

Technical Problem

Example embodiment of the present invention provides a feeding system for reducing size of an antenna and enhancing convenience of use, and a phase shifter and a delay device included in the same.

Technical Solution

A phase shifter according to one embodiment of the present invention includes a first substrate; a first pattern as a conductor disposed on the first substrate; a second substrate separated from the first substrate; and a second pattern as a conductor disposed on the second substrate. Here, the first pattern is overlapped with the second pattern, and electrical length of overlapped part of the patterns changes in case of changing phase of an RF signal outputted from the phase shifter.

The first pattern has reverse 'U' shape, and the second pattern has 'U' shape, and wherein a right part of the first pattern is overlapped with a left part of the second pattern.

A first dielectric layer having a certain dielectric constant exists between the first pattern and the second pattern.

First patterns are disposed on the first substrate, and second patterns are disposed on the second substrate. Here, third patterns connected electrically to centers of the first patterns are further disposed on the first substrate, the third patterns are connected electrically to corresponding radiators, and the first patterns are connected electrically each other through corresponding second patterns.

Some of the first patterns are connected electrically to corresponding third patterns through electrical coupling, and the other first patterns are connected directly to corresponding third patterns.

A second dielectric layer exists between the first pattern and corresponding third pattern connected electrically through the electrical coupling.

At least one of the third patterns has different length or width from the other third patterns.

A coupling prevention element for preventing electrical coupling between the third patterns is further formed between the third patterns on the first substrate.

Some of a power supplied to a left part of the first pattern (left part of the reverse 'U' shape) is provided to corresponding third pattern through electrical coupling at a center of the first pattern, and the other power is provided to a right part of the first pattern (right part of the reverse 'U' shape) at the center of the first pattern. Here, width of a part of the left part of the first pattern differs from that of the other left part of the first pattern.

Length of the third pattern is determined in accordance with frequency of an antenna employing the phase shifter.

The second substrate moves under the condition that the first substrate is fixed in case of changing the phase, some of the second patterns have different shape from the other second patterns, and a ground plate is formed on a rear surface of the first substrate.

A sub-phase shifter according to one embodiment of the present invention includes a first substrate; and a first pattern as a conductor disposed on the first substrate. Here, the first pattern is overlapped with a second pattern as a conductor disposed on a second substrate which separates from the first substrate, and electrical length of overlapped part of the patterns changes in case of changing phase corresponding the sub-phase shifter.

The first pattern has reverse 'U' shape, and the second pattern has 'U' shape, and wherein a right part of the first pattern is overlapped with a left part of the second pattern.

A first dielectric layer is disposed on the first pattern and locates between the first pattern and the second pattern.

First patterns are disposed on the first substrate, and second patterns are disposed on the second substrate. Here, the first patterns are connected electrically each other through corresponding second patterns, the sub-phase shifter includes further third patterns connected electrically to centers of the first patterns on the first substrate, and the third patterns are connected electrically to corresponding radiators.

Some of the first patterns are connected electrically to corresponding third pattern through electrical coupling, and the other first pattern is connected directly to corresponding third pattern.

The sub-phase shifter further includes a second dielectric layer located between the first pattern and corresponding third pattern connected electrically through the electrical coupling.

At least one of the third patterns has different length or width from the other third patterns.

The sub-phase shifter further includes a coupling prevention element located between the third patterns to prevent coupling between the third patterns.

Some of a power supplied to a left part of the first pattern (left part of the reverse 'U' shape) is provided to corresponding third pattern through electrical coupling at a center of the first pattern, and the other power is provided to a right part of the first pattern (right part of the reverse 'U' shape) at the center of the first pattern. Here, width of a part of the left part of the first pattern differs from that of the other left part of the first pattern.

Length of the third pattern is determined in accordance with frequency of an antenna employing the sub-phase shifter.

A sub-phase shifter according to another embodiment of the present invention includes a second substrate separated from a first substrate on which a first pattern as a conductor is disposed; and a second pattern as a conductor disposed on the second substrate. Here, the second pattern overlaps with the first pattern, and electrical length of overlapped part of the patterns change in case of changing phase.

The first pattern has reverse 'U' shape, and the second pattern has 'U' shape. Here, a right part of the first pattern is overlapped with a left part of the second pattern.

A delay device according to one embodiment of the present invention includes a first substrate; a first pattern as a conductor disposed on the first substrate, and configured to have reverse 'U' shape; a second substrate separated from the first substrate; and a second pattern as a conductor disposed on the second substrate, and configured to have 'U' shape. Here, a right part of the first pattern overlaps with a left part of the second pattern, and electrical length of overlapped part of the patterns is determined in proportion to phase delay of corresponding signal.

A dielectric layer exists between the first pattern and the second pattern.

The second substrate moves under the condition that the first substrate is fixed, and a ground plate is formed on a rear surface of the first substrate.

Length of a right part of the first pattern is as same as that of a left part of the second pattern.

Advantageous Effects

A feeding system of the present invention provides an inputted power to following ports through a method of overlapping first patterns having reverse 'U' shape disposed in sequence with second patterns having 'U' shape for connecting electrically the first patterns, and outputs a power inputted into the first patterns to corresponding output terminal, and thus multi ports, e.g. fifteen ports may be realized. For example, the feeding system may feed corresponding power to fifteen radiators. Accordingly, size of an antenna employing the feeding system may reduce.

Since multi ports are controlled by managing only one feeding system, it is easy and convenient to use the feeding system.

In addition, the feeding system delays or divides an inputted power, and so the feeding system may be used as various devices such as a delay device, etc. as well as a phase shifter.

BRIEF DESCRIPTION OF THE DRAWINGS

Example embodiments of the present invention will become more apparent by describing in detail example embodiments of the present invention with reference to the accompanying drawings, in which.

DETAILED DESCRIPTION OF THE INVENTION

Figure 1:
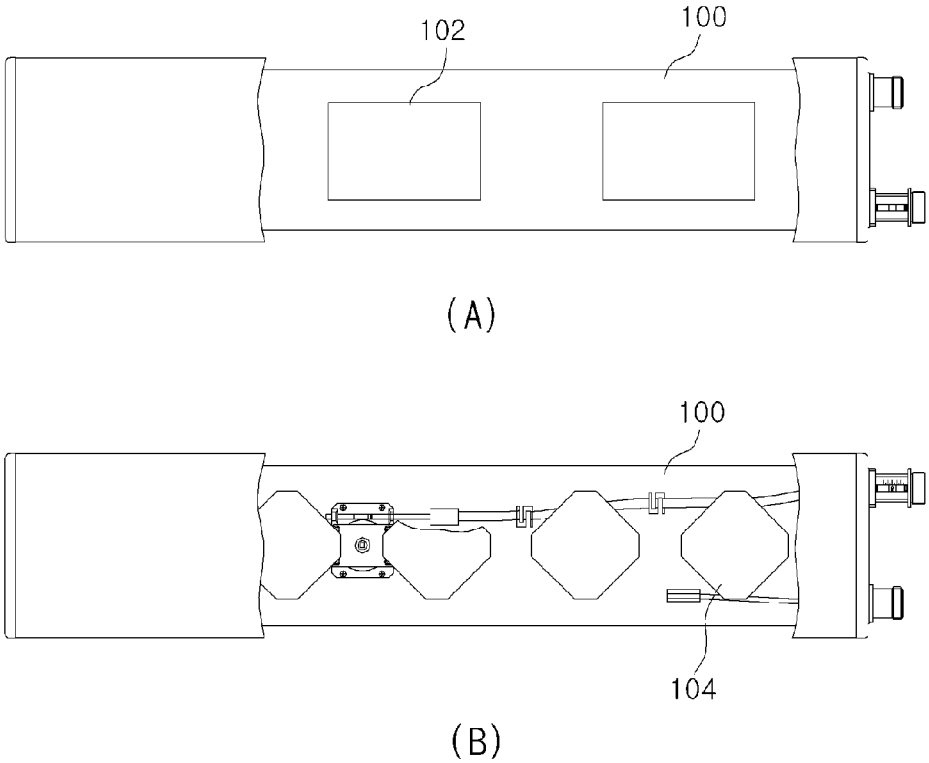
FIG. 1 RELATED ART
FIGS. 1A & 1B are views illustrating a common antenna.

Hereinafter, embodiments of the present invention will be described in detail with reference to accompanying drawings, where like features are designated by the same reference labels throughout the drawing figures.

Figure 2:
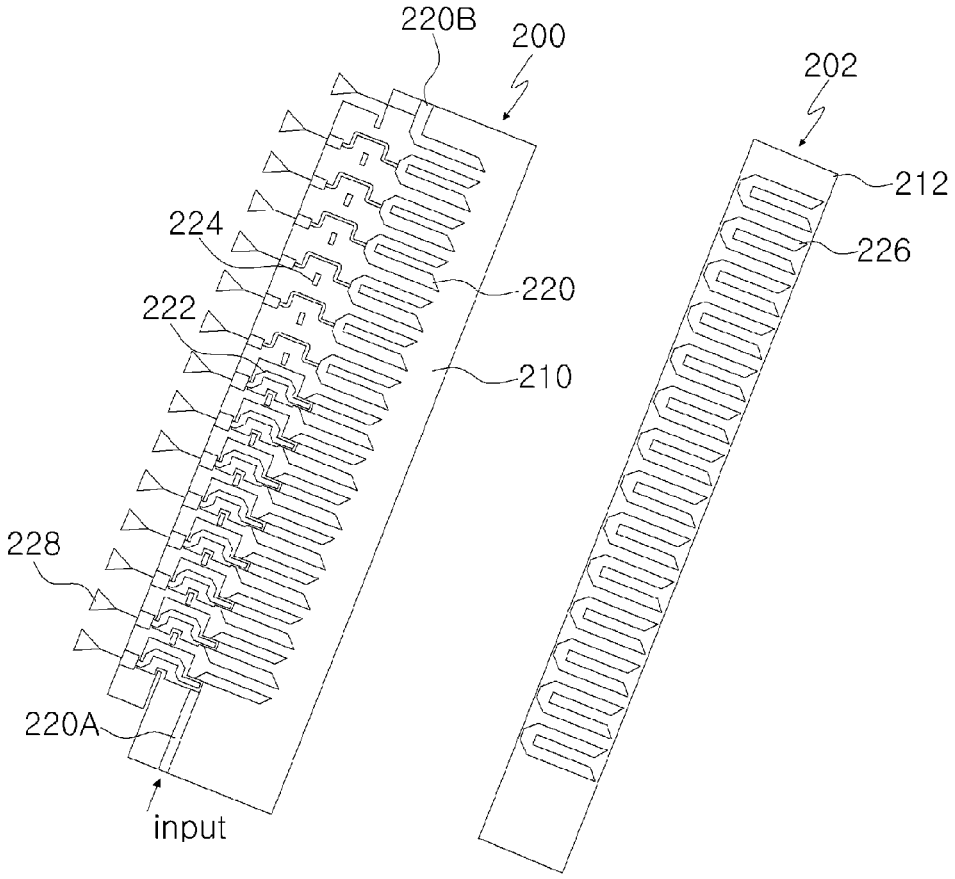
FIG. 2 is a view illustrating a feeding system according to one embodiment of the present invention.
Figure 3:
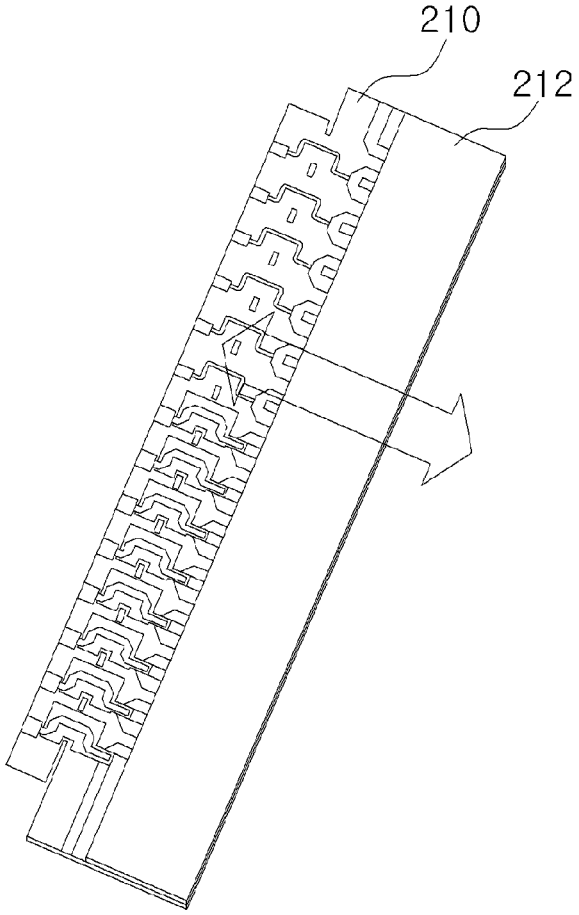
FIG. 3 is a view illustrating operation of the feeding system in FIG. 2.

FIG. 2 is a view illustrating a feeding system according to one embodiment of the present invention, and FIG. 3 is a view illustrating operation of the feeding system in FIG. 2.

The feeding system of the present invention supplies a power inputted from an outer device to another device through an output terminal, and includes for example a phase shifter and a delay device and so on.

Hereinafter, structure and operation of the feeding system will be described in detail through the phase shifter.

In FIG. 2, the phase shifter includes a first sub-phase shifter 200 and a second sub-phase shifter 202.

The first sub-phase shifter 200 includes a first dielectric substrate 210, at least one first pattern 220, one or more third pattern 222 and at least one coupling prevention element 224.

The second sub-phase shifter 202 includes a second dielectric substrate 212 and at least one second pattern 226.

The first dielectric substrate 210 is disposed on one surface of a reflector (not shown), and is made up of dielectric material having certain dielectric constant. A ground plate is formed on a rear surface of the first dielectric substrate 210 as described below.

The first pattern 220 is a conductor, and is formed on the first dielectric substrate 210. In one embodiment of the present invention, the first pattern 220 may have reverse 'U' shape as shown in FIG. 2. However, the first pattern 220 may be also referred to have 'U' shape in accordance with the visual angle. Here, 'U' shape means every pattern including a left pattern, a middle pattern and a right pattern as described below.

One of the first patterns 220, labeled 220A in FIG. 2, functions as an input terminal, i.e. a power is inputted from an outer device through the pattern 220A. Subsequently, the inputted power is finally outputted to corresponding radiator 228 through a pattern 220B located at side of an output terminal. In case that the feeding system is not the phase shifter, the inputted power is not outputted to the radiator 228 but is outputted to other device.

The third pattern 222 is a conductor, is formed on the first dielectric substrate 210, and is connected electrically to corresponding first pattern 220. In addition, the third pattern 222 is connected electrically to corresponding radiator 228. Accordingly, the power inputted to the first patterns 220 is provided to the radiators 228 through corresponding third patterns 222, and so the radiators 228 outputs a beam. Here, phase of the power (RF signals) transmitted through the third patterns 222 may differ respectively. This will be described below.

In one embodiment of the present invention, one or more of the third patterns 222 may have different impedance from the other third patterns as shown in FIG. 2. For example, at least one of the third patterns 222 may have different length or width from the other third patterns. As a result, magnitude of the power provided to each of the radiators 228 may differ. Here, the impedance is determined according to characteristics of desired beam. Additionally, length of the third pattern 222 may be changed in accordance with frequency of the antenna.

The coupling prevention elements 224 are conductors, and are disposed between the third patterns 222 on the first dielectric substrate 210 to prevent coupling between the third patterns 222.

The second dielectric substrate 212 is made up of dielectric material having certain dielectric constant. The dielectric constant of the second dielectric substrate 210 is as same as the first dielectric substrate 210 or differs from that of the first dielectric substrate 210.

The second patterns 226 are conductors, and may be disposed regularly on the second dielectric substrate 212. In one embodiment of the present invention, the second pattern 226 may have 'U' shape as shown in FIG. 2.

The second sub-phase shifter 202 locates on the first sub-phase shifter 200 as shown in FIG. 3, and moves as shown in FIG. 3 when the phase is changed. Here, the second patterns 226 connect electrically the first patterns 220 as described below.

Hereinafter, a process of changing the phase through the phase shifter will be described in detail with reference to accompanying drawings.

Figure 4:
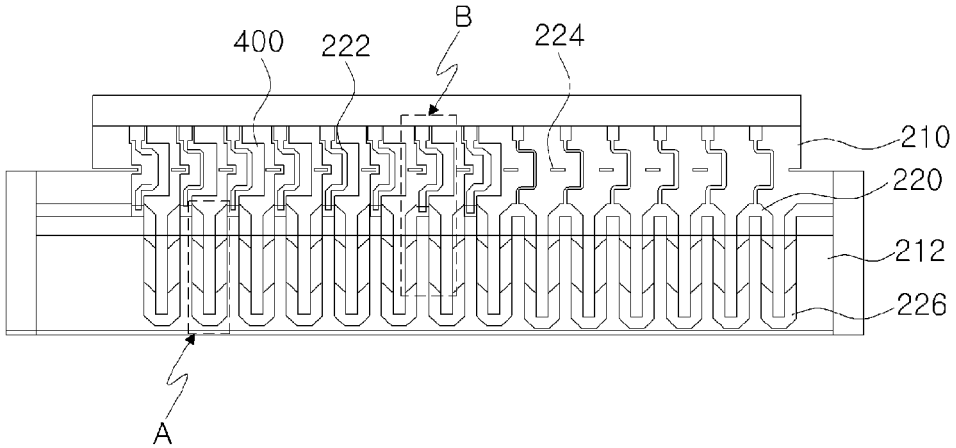
FIG. 4 is a view illustrating operation of a feeding system according to one embodiment of the present invention.
Figure 5:
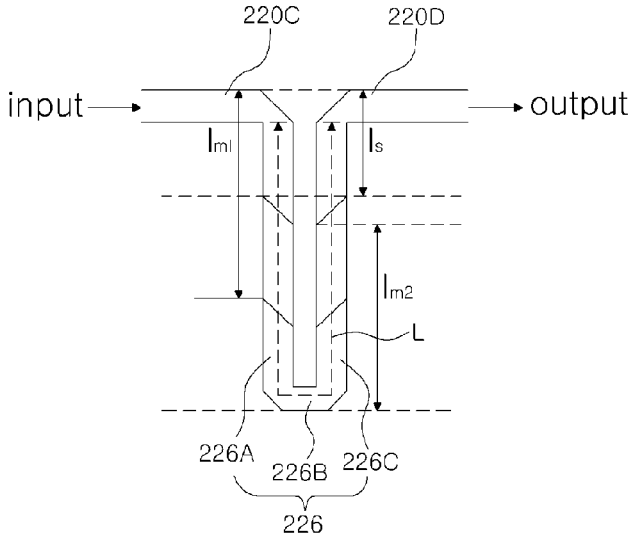
FIGS. 5A & 5B are views illustrating an enlarged view of section "A" in FIG. 4 according to one embodiment of the present invention.
Figure 5:
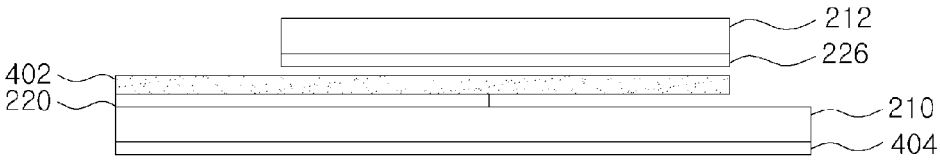

FIG. 4 is a view illustrating operation of a feeding system according to one embodiment of the present invention, and FIG. 5A is a view illustrating an enlarged view of section "A" in FIG. 4 according to one embodiment of the present invention.

In case that the second sub-phase shifter 202 locates on the first sub-phase shifter 200 as shown in FIG. 3, the first patterns 220 and the second patterns 226 are overlapped as shown in FIG. 4 and FIG. 5(A). Particularly, as shown in FIG. 5A for example, a left pattern 226A of the second pattern 226 is overlapped with a right pattern of a first pattern 220C, and a right pattern 226C of the second pattern 226 is overlapped with a left pattern of a first pattern 220D. As a result, the first pattern 220C is connected electrically to the first pattern 220D through the second pattern 226 including the left pattern 226A, a middle pattern 226B and the right pattern 226C. That is, the first patterns 220 are connected electrically each other through corresponding second pattern 226 as shown in FIG. 4.

In view of power, a power inputted to the first pattern 220C is provided to or outputted from the first pattern 220D through the second pattern 226 as shown in FIG. 4 and FIG. 5A.

As shown in FIG. 5A, it is assumed that length of side pattern (right pattern or left pattern) of the first patterns 220C and 220D is $l_{m1}$ and length of side pattern (right pattern or left pattern) of the second pattern 226 is $l_{m2}$. In this case, the first pattern 220C or 220D and the second pattern 226 may be overlapped maximally by smaller value of $l_{m1}$ and $l_{m2}$. Generally, a part of the first pattern 220C or 220D and a part of the second pattern 226 are overlapped as shown in FIG. 5(A).

If length of a pattern not overlapped of the first pattern 220C or 220D is $l_s$ and $l_{m1}$ and $l_{m2}$ are the same, $0 \le l_s \ll l_{m1}$.

Since the second sub-phase shifter 202 moves on the first sub-phase shifter 200 as mentioned above, size of an area by which the first pattern 220C or 220D and the second pattern 226 are overlapped is changed. As a result, $l_s$ and electrical length L change in accordance with the movement. Accordingly, phase $\phi$ of the power outputted to the first pattern 220D changes in accordance with change of $l_s$, i.e. the electrical length L as shown in following Equation 1.

$$\Delta\varphi = 2 \cdot \Delta l_s \cdot \frac{2\pi}{\lambda_g} \qquad \text{[Equation 1]}$$

where $\lambda_g$ is wavelength of the RF signal.

Referring to Equation 1, the change in phase $\Delta\phi$ changes in proportion to the change in length $\Delta l_s$. Here, the electrical length L changes in proportion to $\Delta l_s$.

FIG. 5(A) shows only one overlapped pattern of patterns in FIG. 4. In reality, (n−1) overlapped patterns exist in n port phase shifter. In this case, total electrical length $l_T$ of the overlapped patterns is as same as following Equation 2.

$$(n-1) \cdot \frac{\lambda_{g,max}}{2} < l_T < n \cdot \frac{\lambda_{g,min}}{2}, \qquad \text{[Equation 2]}$$

$$n = 1, 2, 3, \ldots \text{ (integer)}$$

$$\lambda_g = \frac{c}{f} \cdot \frac{1}{\sqrt{\varepsilon_r}}$$

where $\lambda_{g,max}$ means the greatest wavelength in a band of the phase shifter, $\lambda_{g,min}$ indicates the smallest wavelength in the band, and $\in_r$ is dielectric constant of the first dielectric substrate 210.

Referring to Equation 2, the total electrical length $l_T$ of the overlapped patterns changes according to wavelength corresponding to the number of ports and bandwidth.

In another view, a power (RF signal) outputted to the first pattern 220D is delayed in case that the electrical length L increases according as the second sub-phase shifter 202 moves in the right direction in FIG. 3. The structure shown in FIG. 5(A) corresponds to a part of the phase shifter, but may function as a delay device in itself. Namely, the feeding system of the present embodiment may operate as the delay device through the method of overlapping the first patterns 220 and the second patterns 226. Here, the delay time is determined in accordance with the number of the patterns 220 and 226 and the length of the overlapped part of the patterns.

Hereinafter, sectional view of the structure shown in FIG. 5(A) will be described.

As shown in FIG. 5(B), the first pattern 220 is formed on the first dielectric substrate 210, and the second pattern 226 is formed on the second dielectric substrate 212. Additionally, a ground plate 404 is formed on a rear surface of the first dielectric substrate 210.

In one embodiment of the present invention, a dielectric layer 402 having certain dielectric constant exists between the first pattern 220 and the second pattern 226. For example, the dielectric layer 402 is formed on the first patterns 220, and is used for reducing the passive intermodulation distortion (PIMD) and preventing corrosion.

Figure 6:
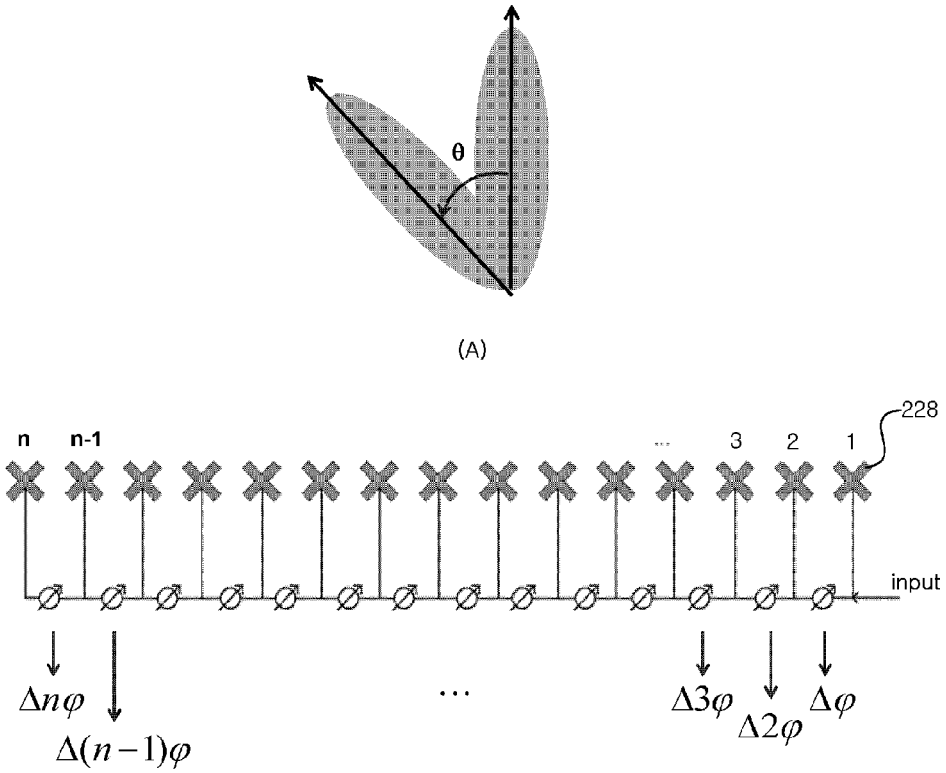
FIGS. 6A & 6B are views illustrating a process of controlling phase by the phase shifter according to one embodiment of the present invention.

FIGS. 6A & 6B are views illustrating a process of controlling phase by the phase shifter according to one embodiment of the present invention.

In the process illustrated in FIG. 6B, n (integer of above 2) third patterns are formed on the first dielectric substrate, and the third patterns may be connected electrically to n radiators 228 (labeled 1, 2, 3 . . . n−1, n in FIG. 6B).

If an overlapped area of the first patterns 220 and the second patterns 226 changes constantly according to moving of the second sub-phase shifter, a part of a power inputted to an input terminal (front pattern of the first patterns, 220A in FIG. 2) is provided without change of phase to a first radiator 228 through a third pattern 222, and the other power is delivered to next first pattern 220. A part of the power delivered to the first pattern 220 is provided with phase changed by $\Delta\phi$ corresponding to change $2\Delta 1$ of the overlapped area of the patterns 220 and 226 to a second radiator 228 through a third pattern 222, and the other power is delivered to next first pattern 220. A part of the power delivered to the first pattern 220 is provided with phase changed by $\Delta 2\phi$ corresponding to accumulated change $4\Delta 1$ of the overlapped area of the patterns 220 and 226 to a third radiator 228 through a third pattern 222, and the other power is delivered to next first pattern 220.

That is, RF signals having phase changed in sequence by $\Delta\phi$, $\Delta 2\phi$, $\Delta 3\phi$, . . . , $\Delta(n-1)\phi$ . . . , $\Delta n\phi$ are inputted to the radiators 228 as shown in FIG. 6(B), and so the tilting angle of the beam may be adjusted by $\theta$ as shown in FIG. 6(A).

In brief, the phase shifter of the present embodiment realizes desired tilting angle by controlling length of overlapped parts of the first patterns 220 and the second patterns 226.

In the conventional antenna, many phase shifters are needed so as to achieve multi ports, i.e. provide the power to the radiators. However, since the present invention realizes multi ports by increasing the number of the patterns 220 and 226 in one phase shifter, size of the antenna may reduce.

In addition, the conventional antenna controls respectively the phase shifters to adjust the tilting angle. However, the phase shifter of the present invention may adjust the tiling angle through simple operation of moving the second sub-phase shifter 202, and thus convenience of use is enhanced.

Furthermore, the feeding system of the present invention operates as the phase shifter, but enables to function as the delay device, etc. In other words, the feeding system may be utilized variously.

Figure 7:
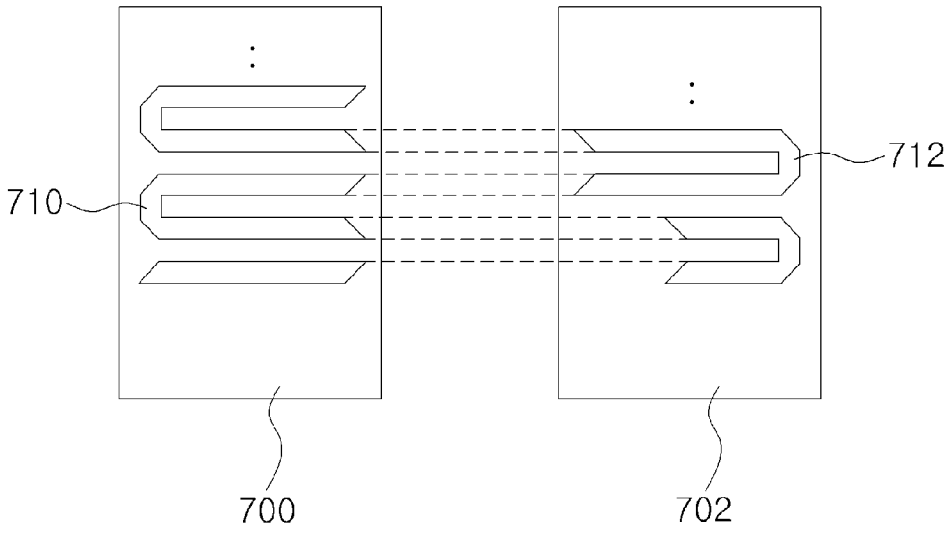
FIG. 7 and FIG. 8 are views illustrating schematically a feeding system according to another embodiment of the present invention.
Figure 8:
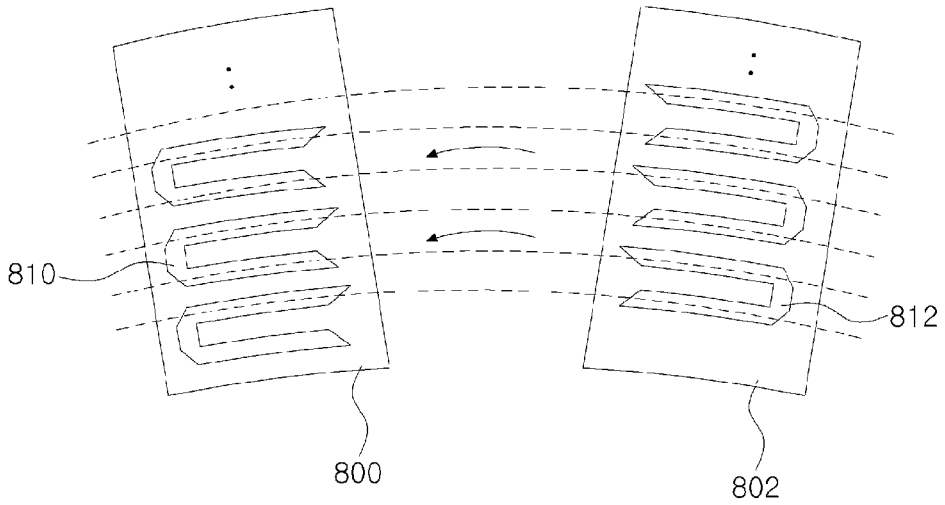

FIG. 7 and FIG. 8 are views illustrating schematically a feeding system according to another embodiment of the present invention.

In FIG. 7, first patterns 710 are formed on a first dielectric substrate 700, and second patterns 712 are formed on a second dielectric substrate 702.

Some of the second patterns 712 may have different structures, e.g. different size from the other second patterns. That is, the second patterns 712 in the feeding system of the present embodiment may have different structure from the second patterns 226 shown in FIG. 2. Some of the first patterns 710 may have also different structures from the other first patterns unlike the first patterns 200 shown in FIG. 2.

The second dielectric substrate 702 may move on the first dielectric substrate 700.

In FIG. 8, first patterns 810 are formed on a first dielectric substrate 800, and second patterns 812 are formed on a second dielectric substrate 802. The second dielectric substrate 802 may move on the first dielectric substrate 800. However, the second dielectric substrate 802 may move along a curve as shown in FIG. 8 unlike the second dielectric substrate 212 in FIG. 2 which moves linearly.

In short, the structure of the first patterns, the structure of the second patterns and the method of overlapping the first patterns and the second patterns in the feeding system of the present invention may be variously modified as long as the first patterns and the second patterns are overlapped to connect electrically the first patterns each other.

Figure 9:
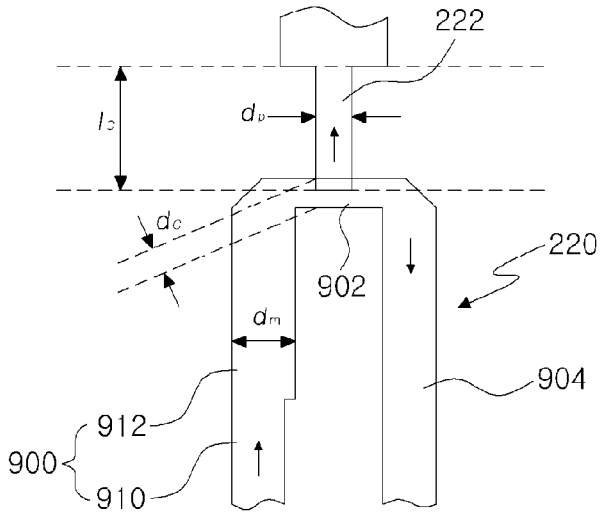
FIGS. 9A & 9B are views illustrating an enlarged view of section B in FIG. 4 according to one embodiment of the present invention.
Figure 9:
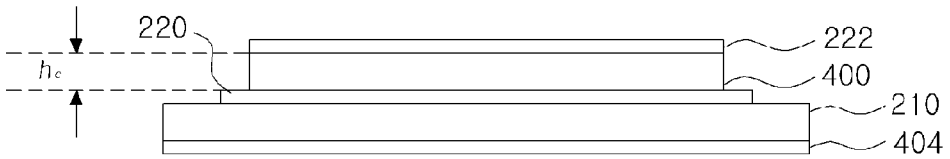

FIGS. 9A & 9B are views illustrating an enlarged view of section B in FIG. 4 according to one embodiment of the present invention. FIG. 9A shows only part of the first sub-phase shifter 200 of FIG. 2 but not the second sub-phase shifter 202 of FIG. 2.

As shown in FIG. 9(A), the first pattern 220 is connected electrically to the third pattern 222. In one embodiment of the present invention, the third pattern 222 may be connected electrically to a middle pattern 902 of the first pattern 220 through electrical coupling or be connected directly to the middle pattern 902. It is desirable that the third pattern 222 is connected electrically to the middle pattern 902 through the electrical coupling at side of an input terminal to which a power is inputted as shown in FIG. 4 because the patterns 220 and 222 may be broken down due to high power. Whereas, the patterns 220 and 222 are not broken down because magnitude of a power reduces at side of a rear terminal, and so the third pattern 222 is preferably connected directly to the first pattern 220 in consideration of loss (return loss).

Referring to the coupling, a dielectric layer 400 is formed between the first pattern 220 and the third pattern 222 as shown in FIG. 9(B).

Hereinafter, a process of delivering a power in the structure in FIGS. 9A & 9B will be described in detail.

The first pattern 220 includes a left pattern 900, the middle pattern 902 and a right pattern 904, and a power is inputted to an input pattern 910 of the left pattern 900.

Subsequently, the power inputted into the input pattern 910 passes through a matching pattern 912 of the left pattern 900, and then the passed power is divided into the right pattern 904 and the third pattern 222 at the middle pattern 902. In this case, the division of the power is affected by thickness $h_c$ of the dielectric layer 400, as shown in FIG. 9B, width $d_p$ of the third pattern 222, length $l_c$ of the third pattern 222 and width $d_c$ of the middle pattern 902 as shown in FIG. 9A.

Since it is important to minimize loss of the power in the above process of delivering the power, the feeding system of the present invention considers impedance matching.

Now referring to FIG. 9(A), the matching pattern 912 of the left pattern 900 and the middle pattern 902 performs impedance matching when the power is delivered from the left pattern 900 of the first pattern 220 to the third pattern 222. Particularly, the impedance matching may be realized by controlling width $d_m$, of the matching pattern 912 and the width $d_c$ of the middle pattern 902. Here, the width $d_c$ of the middle pattern 902 corresponds to inductive component for adjusting capacitance in accordance with the thickness $h_c$ of the dielectric layer 400. In one embodiment of the present invention, the width $d_m$ of the matching pattern 912 is higher than that of the input pattern 910.

Referring to impedance matching when the power is delivered from the left pattern 900 of the first pattern 220 to the right pattern 904, the matching pattern 912 of the left pattern 900 and the middle pattern 902 performs impedance matching. In one embodiment of the present invention, the width $d_m$ of the matching pattern 912 is higher than the width of the input pattern 910, and the width of the input pattern 910 may be as same as the width of the right pattern 904.

In other words, the impedance matching is affected mainly by the width $d_m$ of the matching pattern 912 and the width $d_c$ of the middle pattern 902. Here, since the power delivered to the third patterns 222 may differ, the widths $d_m$ of the matching patterns 912 of the first patterns 220 may be different. Consequently, some of the first patterns 220 may have different shape, e.g. width $d_m$, from the other first patterns.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A phase shifter comprising:

a first substrate;

first patterns as a conductor disposed on the first substrate;

a second substrate separated from the first substrate;

second patterns as a conductor disposed on the second substrate, and third patterns connected electrically to the first patterns on the first substrate;

wherein the first patterns are overlapped with the second patterns, electrical length of overlapped parts of the first patterns and the second patterns changes in case of changing phase of an RF signal outputted from the phase shifter, and a first dielectric layer exists between at least one of the first patterns and corresponding third patterns.

2. The phase shifter of claim 1, wherein at least one of the second patterns is a 'U' shaped line, a shape of the first pattern is reverse to a shape of the second pattern having the 'U' shaped line, and a part of the second patterns is overlapped with the first patterns.

3. The phase shifter of claim 2, wherein a second dielectric layer having a certain dielectric constant exists between the overlapped part of the first pattern and the second pattern.

4. The phase shifter of claim 2, wherein the third patterns are connected electrically to corresponding radiators, and the first patterns are connected electrically to each other through corresponding second patterns.

5. The phase shifter of claim 4, wherein a width of at least one part of the first patterns differs from that of another part of the first patterns.

6. The phase shifter of claim 2, wherein the second substrate moves under the condition that the first substrate is fixed in case of changing the phase, and a ground plate is formed on a rear surface of the first substrate.

7. A phase shifter comprising:

a first substrate;

first patterns as a conductor disposed on the first substrate;

a second substrate separated from the first substrate;

second patterns as a conductor disposed on the second substrate; and third patterns connected electrically to the first patterns on the first substrate, wherein the first patterns are overlapped with the second patterns, electrical length of overlapped parts of the first patterns and the second patterns changes in case of changing phase of an RF signal outputted from the phase shifter, and at least one of the third patterns has different length or width from the other third patterns.

8. A phase shifter comprising:

a first substrate;

first patterns as a conductor disposed on the first substrate;

a second substrate separated from the first substrate;

second patterns as a conductor disposed on the second substrate;

third patterns connected electrically to the first patterns on the first substrate; and at least one coupling prevention element disposed between the third patterns on the first substrate to prevent electrical coupling between the third patterns, wherein the first patterns are overlapped with the second patterns, and electrical length of overlapped parts of the first patterns and the second patterns changes in case of changing phase of an RF signal outputted from the phase shifter.

9. A sub-phase shifter comprising:

a first substrate;

first patterns as a conductor disposed on the first substrate, second patterns as a conductor disposed on a second substrate which separates from the first substrate, wherein the first patterns are overlapped with the second patterns and electrical length of overlapped parts of the first patterns and the second patterns changes in case of changing phase of the sub-phase shifter; and third patterns connected electrically to the first patterns on the first substrate, wherein at least one of the third patterns has different length or width from the other third patterns.

10. The sub-phase shifter of claim 9, wherein a width of at least one part of the first patterns differs from that of another part of the first patterns.

11. The sub-phase shifter of claim 9, further comprising:

a coupling prevention element located between the third patterns to prevent coupling between the third patterns.

12. The sub-phase shifter of claim 9, further comprising:

a second dielectric layer located between the first patterns and the third patterns.

13. The sub-phase shifter of claim 9, wherein at least one of the second patterns is a 'U' shaped line, a shape of the first pattern is reverse to a shape of the second pattern having the 'U' shaped line, and a part of the second patterns is overlapped with the first patterns.

14. The sub-phase shifter of claim 13, wherein a first dielectric layer is located between the first patterns and the second patterns.

15. A delay device comprising:

a first substrate;

first patterns as a conductor disposed on the first substrate;

a second substrate separated from the first substrate; and second patterns as a conductor disposed on the second substrate; and third patterns connected electrically to the first patterns on the first substrate, wherein the first patterns are overlapped with the second patterns, and electrical length of overlapped parts of the first patterns and the second patterns changes in case of changing phase of an RF signal outputted from the delay device, and at least one of the third patterns has different length or width from other third patterns.

* * * * *